United States Patent [19]

Myers et al.

[11] 4,042,179

[45] Aug. 16, 1977

[54] MIXER WITH SCREEN VALVE

[76] Inventors: Claude K. Myers; Gary A. Myers, both of 8376 Salt Lake Ave., Bell, Calif. 90201

[21] Appl. No.: 664,641

[22] Filed: Mar. 8, 1976

[51] Int. Cl.[2] ..... B02C 23/36

[52] U.S. Cl. ..... 241/46.11; 241/171

[58] Field of Search ..... 241/46.17, 46.11, 171; 137/331, 333; 251/318; 4/189, 190, 287

[56] References Cited

U.S. PATENT DOCUMENTS

| | | | |
|---|---|---|---|
| 1,907,785 | 5/1933 | Garlick | 241/171 |
| 2,464,588 | 3/1949 | Knudsen et al. | 241/46.17 |
| 2,612,904 | 10/1952 | Richards et al. | 137/333 |
| 2,764,359 | 9/1956 | Szeguari | 241/46.17 X |
| 3,050,263 | 8/1962 | Barkman et al. | 241/46.17 X |
| 3,765,316 | 10/1973 | Skoch | 251/318 X |

*Primary Examiner*—Granville Y. Custer, Jr.

[57] ABSTRACT

A mixer for mixing material such as paint, plastics etc. using a grinding media and comprising a container with an agitator for producing the mixing action. An outlet for the mixed material is provided at the bottom of the container with a poppet valve for closing and opening the outlet. The valve permits emptying of the mixed material while retaining the grinding media in the container. The valve is cylindrical, sliding between a lowered closed position and a raised open position, with an apertured side wall, typically a metal screen. The valve may be rotated and/or lowered and raised during the emptying process freeing the screen of packed or settled material for complete emptying of mixed material.

1 Claim, 5 Drawing Figures

MIXER WITH SCREEN VALVE

BACKGROUND OF THE INVENTION

This invention relates to a mixer with a new outlet valve and in particular, to a container with a poppet valve located at the bottom outlet, which valve may be lowered for closing the outlet and raised for emptying the container, permitting mixing of successive batches of material with grinding media without requiring external separation of the grinding media.

Mixers have been used for making various materials such as paint, plastics, inks and powders. A grinding media such as glass beads, metal shot, pebbles, and the like, is used with the material being mixed for the purpose of producing the desired fineness and homogeneity in the resulting mixed material.

Typically such a mixer includes a container with cover and a motor-driven agitator for positioning adjacent the bottom of the container, with the agitator shaft passing upward through the cover. Means may be provided for heating the container and/or introducing steam during the mixing operation, as desired.

One of the principal problems associated with this mixing process is the separation of the grinding media from the fluid material when the mixing is completed. In the prior art containers, a fixed screen is positioned at an outlet opening in the bottom or in the side near the bottom, with the outlet opening closed by an outer cover. The screen is exposed to the batch and media and there is heavy wear on the screen during mixing, requiring frequent replacement of the screen. Accordingly, it is the object of the present invention to provide a new and improved mixer incorporating means for separating the grinding media from the mixed material at the time the material is removed from the mixing container, which separating means is protected during the mixing operation. A further object is to provide such a mixer wherein the separating means, typically a screen, may be moved during emptying of the container to displace media which tends to pack at the screen.

SUMMARY OF THE INVENTION

The mixer includes a container for the material to be mixed and a grinding media, and has an outlet opening at the bottom. An agitator for producing the mixing is positioned in the container, preferably adjacent the bottom. A poppet valve is mounted in the outlet opening for sliding between a lowered position closing the outlet opening and a raised position permitting flow through the outlet opening. In the preferred embodiment, the valve is cylindrical with a closed top and an apertured or screened side, with the apertured side positioned below the outlet opening when the valve is in the lowered position. A mechanism is provided for rotating the valve while in the raised position to free the valve of packed or settled material which would impede fluid flow through the apertured side. Also, the valve may be lowered and raised during emptying for loosening packed media.

DESCRIPTION OF THE PREFERRED EMBODIMENTS

Figure 1:
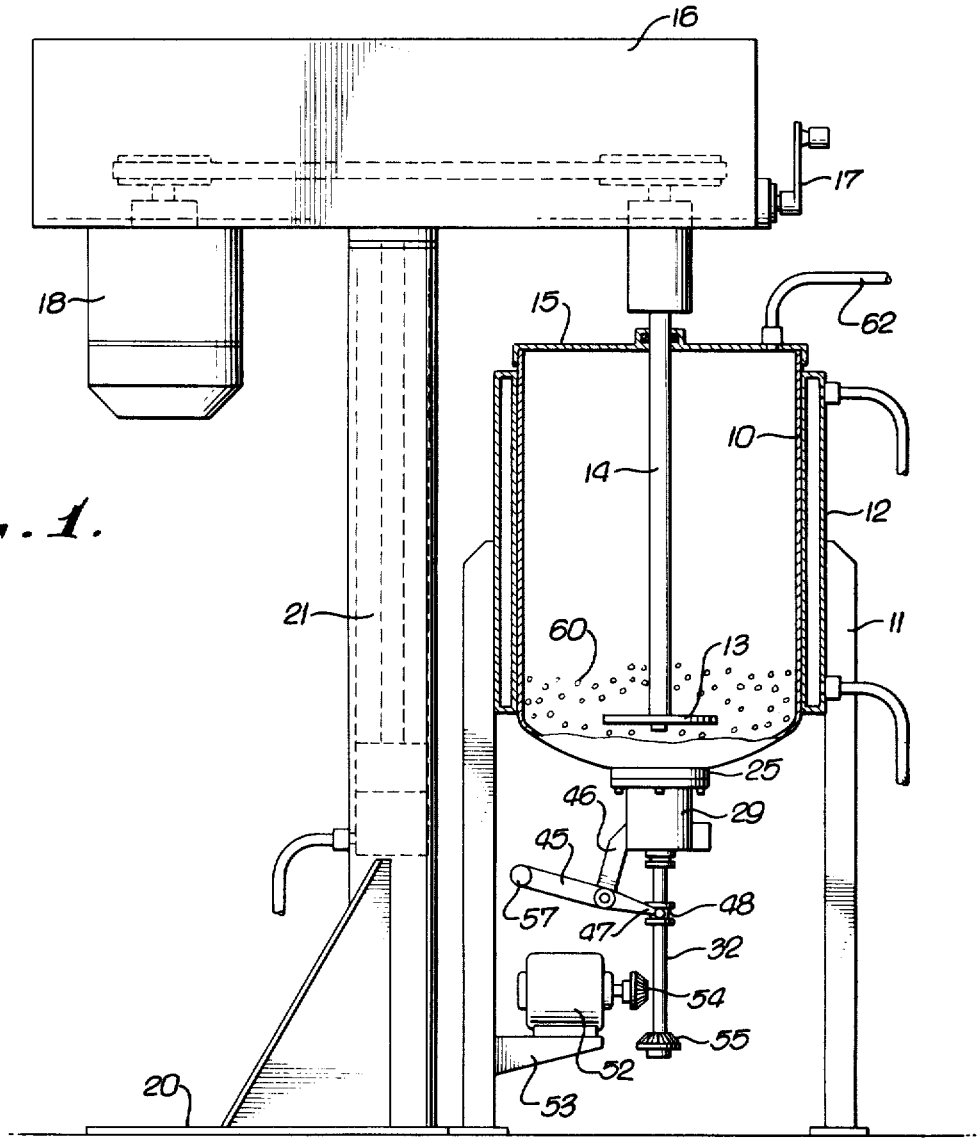
FIG. 1 is a side view of a mixer, partly in section, incorporating one embodiment of the invention.

The mixer of FIG. 1 includes a container 10 mounted on legs 11. The container may be enclosed in a jacket 12 providing for heating or cooling as desired. An agitator 13 is mounted on a shaft 14 journaled in a container cover 15, with the shaft supported from a drive head 16. The drive head 16 may contain a variable speed transmission controlled by lever 17 and powered by an electric motor 18. The drive head is supported from a base 20 and is raised and lowered by a hydraulic cylinder 21. The drive head is shown in a lowered position in FIG. 1 with the agitator in position for mixing in the container. When it is desired to load the container, the drive head is raised removing the cover and raising the agitator. Alternatively, the drive head and shaft may be permanently mounted on a container, with a lid or other opening for access. The mixer thus described is conventional.

Figure 2:
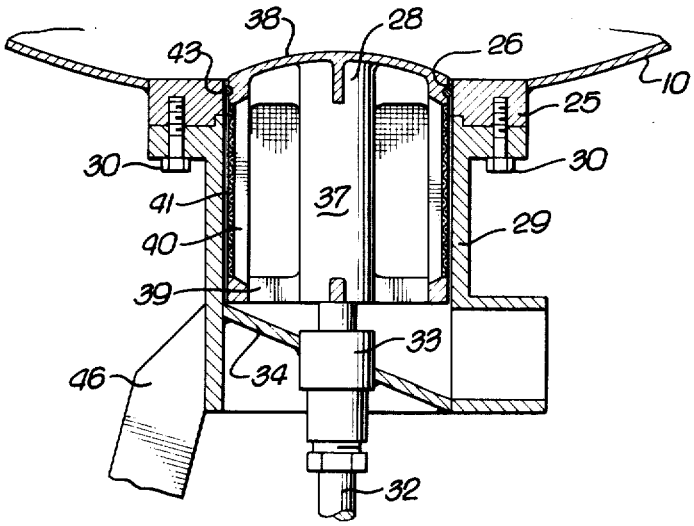
FIG. 2 is an enlarged partial sectional view of the mixer of FIG. 1 showing the valve in the lowered closed position.
Figure 3:
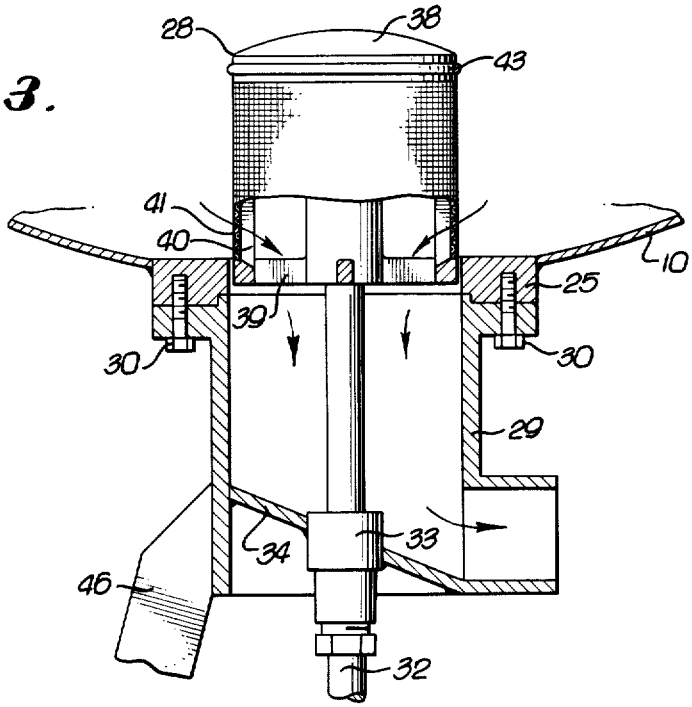
FIG. 3 is a view similar to that of FIG. 2 showing the valve in the raised open position.

An outlet opening for emptying the container and a valve for closing the outlet opening are provided at the bottom of the container. In the embodiment of FIGS. 1–3, a flange 25 is fixed in the bottom of the container 10, with an outlet opening 26 in the flange. A poppet valve 28 moves up and down within the opening, the valve being shown in the lowered closed position in FIG. 2 and in the raised open position in FIG. 3. A valve housing 29 is supported on the flange 25, as by means of bolts 30. A shaft 32 is journaled in a bushing 33 carried in a plate 34 of the housing 29, with the valve 28 mounted on the shaft 32.

In the embodiment illustrated in FIGS. 1–3, the valve 28 is a casting with a central core 37, a closed top 38, a spider 39 as the bottom, with the side formed of a plurality of ribs 40. The side wall is closed by a metal screen 41. In one alternative configuration, an apertured sheet can be used to close the side wall. In another alternative configuration, the side wall may be integral with the remainder of the valve, with a plurality of openings provided in the wall. An O-ring 43 may be provided at the upper end of the side wall of the valve to provide a sealing engagement with the flange 25.

Means are provided for raising and lowering and for rotating the valve. In the embodiment illustrated in FIGS. 1–3, a lever 45 is mounted on a bracket 46 depending from the housing 29, with one end 47 of the lever engaging an annular groove 48 provided on the shaft 32. A motor 52 with speed reduction unit may be mounted on a bracket 53, with a bevel gear 54 on the output shaft engaging another bevel gear 55 on a shaft 32 when the shaft 32 is raised by pushing downward on the end 57 of the lever 45. Various other construction may be used for the valve and the valve moving mechanism, as desired. A prefabricated cylindrical screen is available and may be used in the valve. Hydraulic, electrical or pneumatic drives for rotation and/or for lifting may be used.

In operation, the drive head 16 is raised and the material to be mixed is introduced into the container 10. Ordinarily, the grinding media typically consisting of glass or ceramic beads or metal balls or pebbles or the like, indicated at 60, is already in the container. The drive head 16 is lowered to the position shown in FIG. 1 and the agitator is operated at the desired speed or speeds for the desired period of time. During the loading and mixing operation, the valve is maintained in the lowered position as shown in FIG. 2 providing a seal at the outlet opening of the container.

When the mixing is completed, the lever 45 is pushed down, raising the valve to the upper position of FIG. 3 permitting fluid flow through the valve screen, the outlet opening and the valve housing, as indicated by the arrows in FIG. 3. The bevel gears 54, 55 are engaged and the motor 52 is energized to rotate the valve during the draining operation. The screen or apertures of the valve restrain the mixing media and any large pieces of the material which have not been properly mixed. The movement of the valve both in rotation and up and down, prevents the material and/or the grinding media from packing or settling at the valve and thereby blocking or inhibiting flow of the mixed material from the container. This operation provides for simultaneous draining of the mixed material and screening of the grinding media so that the grinding media may be retained in the container for immediate use in mixing the next batch of material. As soon as the container is empty, the lever 45 is raised to the position shown in FIG. 1, disengaging the bevel gears and moving the valve downward to the closed position as shown in FIG. 2. The container is immediately ready for mixing another batch of material. The mesh of the screen 41 or the size of the opening in the apertured wall is selected depending upon the size of the grinding media and the fineness of the mixed material. Where desired, draining of the container may be facilitated by continuing to operate the agitator. Also, draining may be facilitated by introducing air or other gas under pressure into the container through line 62, with the cover in place.

Figure 4:
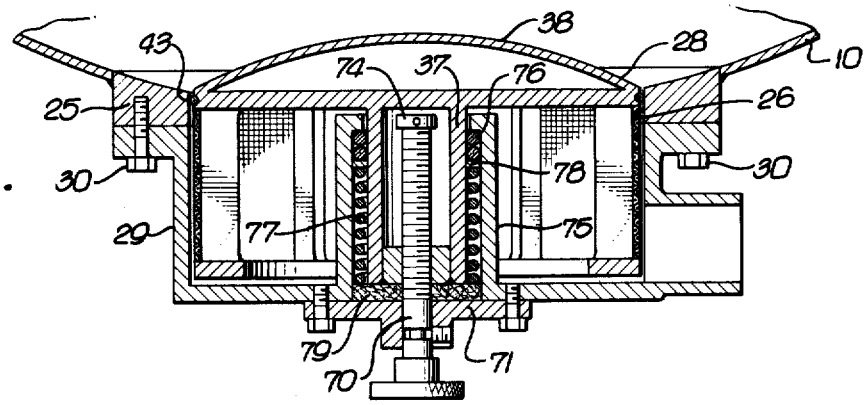
FIG. 4 is a view similar to that of FIG. 2 showing an alternative and presently preferred embodiment of the invention.
Figure 5:
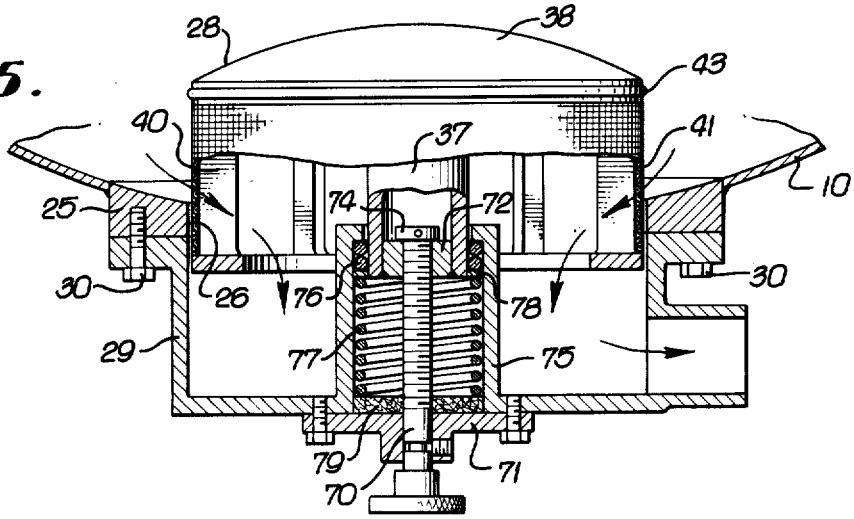
FIG. 5 is a view of the embodiment of FIG. 4 showing the valve in the raised open position.

An alternative embodiment for the poppet valve is shown in FIGS. 4 and 5, with components corresponding to those of the embodiment of FIGS. 1–3 identified by the same reference numerals. A threaded shaft 70 is mounted for rotation in a bushing 71 fixed at the bottom of the valve housing 29. A nut 72 is carried on the shaft, with the nut fixed to the core 37 of the valve. A disc 74 is fixed to the upper end of the shaft 70 to serve as a stop for the nut 72. The central core 37 of the valve rides within a sleeve 75 formed in the housing 29, with a pair of O-rings 76 around the core 37 held in place by a spring 77 and washer 78 to provide a seal. A packing washer 79 may be provided about the shaft 70 at the lower end of the sleeve 75 if desired.

In operation, the shaft 70 is rotated in one direction, typically counter-clockwise, to move the valve downward to the position of FIG. 4 closing the outlet opening of the container. Rotation of the shaft 70 in the opposite direction will advance the nut 72 upward, raising the valve to the open position of FIG. 5 permitting drainage of the container. When the nut 72 engages the stop 74, upward motion of the valve is terminated. Then continued rotation of the shaft 70 will rotate the valve, providing the desired valve rotation during the container draining operation. The shaft 70 may be rotated manually or driven by a motor or other drive means as desired.

We claim:

1. In a mixer for mixing a material and a grinding media, the combination of:

a container for receiving a grinding media and material to be mixed, said container having an outlet opening at the bottom thereof;

agitator means for positioning in said container for mixing the grinding media and material;

a poppet valve mounted in said outlet opening for sliding movement between a lowered position closing said outlet opening and a raised position permitting fluid flow through said outlet opening, said valve being cylindrical in shape with a closed upper end and apertured side for flow of the mixed material therethrough when in said raised position while retaining the grinding media in said container; and means for rotating said valve while in said raised position including a threaded shaft journaled in a bushing below said valve, a nut mounted on said shaft and affixed to said valve, and a stop for limiting movement of said nut along said shaft, with rotation of said shaft in one direction translating said nut and valve from said lowered position to said raised position and when said nut engages said stop, rotating said valve for dislodging grinding media from said apertured side, and with rotation of said shaft in the opposite direction translating said nut and valve from said raised position to said lowered position closing said outlet opening.

* * * * *